US011801524B2

(12) United States Patent
Moretti

(10) Patent No.: US 11,801,524 B2
(45) Date of Patent: Oct. 31, 2023

(54) FLUID SUBSTANCE DISPENSING DEVICE

(71) Applicant: Lumson S.p.A., Capergnanica (IT)

(72) Inventor: Matteo Moretti, Crema (IT)

(73) Assignee: LUMSON S.P.A., Capergnanica (IT)

( * ) Notice: Subject to any disclaimer, the term of this patent is extended or adjusted under 35 U.S.C. 154(b) by 0 days.

(21) Appl. No.: 17/669,667

(22) Filed: Feb. 11, 2022

(65) Prior Publication Data

US 2022/0258191 A1 Aug. 18, 2022

(30) Foreign Application Priority Data

Feb. 16, 2021 (IT) ..... 102021000003455

(51) Int. Cl.
*B05B 11/00* (2023.01)
*B05B 11/10* (2023.01)

(52) U.S. Cl.
CPC ..... *B05B 11/1023* (2023.01); *B05B 11/1001* (2023.01); *B05B 11/1067* (2023.01)

(58) Field of Classification Search
CPC ..... B05B 11/3023; B05B 11/3001; B05B 11/3067; B05B 11/3061; B05B 11/007; B05B 11/0072; B05B 11/3069; B05B 11/3074; B05B 11/30; B05B 11/3042
See application file for complete search history.

(56) References Cited

U.S. PATENT DOCUMENTS 4,960,230 A * 10/1990 Marelli ..... B05B 11/3007 222/321.9
5,186,368 A 2/1993 Garcia
6,609,666 B1 8/2003 Blake
7,500,582 B2 3/2009 Pritchett et al.
10,518,946 B2 * 12/2019 Bloc ..... B65D 47/2068
2003/0231923 A1 12/2003 Heukamp
2008/0237272 A1 * 10/2008 Durant ..... B05B 11/3025 222/321.9
2008/0296318 A1 12/2008 Chevalier
2016/0016722 A1 * 1/2016 Bloc ..... B05B 11/0005 222/394
2019/0061509 A1 2/2019 Kim

FOREIGN PATENT DOCUMENTS

CN 112110030 A 12/2020

* cited by examiner

*Primary Examiner* — Donnell A Long
(74) *Attorney, Agent, or Firm* — Dickinson Wright PLLC; Andrew D. Dorisio

(57) ABSTRACT

A device for dispensing a fluid substance includes a manually operated pump with a hollow stem movable counter to a spring, the hollow stem coupled with a piston which slides in a sealed manner inside a cup body to define a compression chamber coupled with a first valve element for the inlet of the fluid substance into the compression chamber fluidly coupled with a second valve element for the outlet of the fluid substance from the compression chamber, there being a dispensing button equipped with a dispensing nozzle mounted on the hollow stem, the dispensing button featuring at least one channel for supplying the fluid substance to the nozzle; the nozzle is formed of an essentially rigid body which is secured, in a sealed manner, into a seat in the dispenser button, the rigid body being coupled with a deformable body defining a dispensing port so that during dispensing, the deformable body—at least in the vicinity of the dispensing port—deforms and then returns to its non-deformed configuration thereafter.

9 Claims, 2 Drawing Sheets

FLUID SUBSTANCE DISPENSING DEVICE

This application claims the priority of Italian Patent Application No. 102021000003455 filed on Feb. 16, 2021, the disclosure of which is hereby incorporated by reference.

FIELD OF THE INVENTION

The present invention relates to a fluid substance dispensing device.

In particular, it refers to a device for dispensing a fluid substance of a preferably creamy type, dispensed by means of a manually operated pump.

BACKGROUND ART

It is known that the dispensing of creams or creamy substances through manually operated pumps creates problems which are mainly related to the formation of drops or runs at the dispensing outlet of the device.

Another drawback is linked to the possibility that when the cream or creamy substance comes into contact with the air and remains unused for a long time, the said cream or creamy substances dries up, blocking the dispensing outlet with the plug formed thereby, which makes subsequent dispensing difficult.

The commonly known systems that minimise the aforesaid problems are complex from a technical point of view and formed of many parts.

While delivering good results, they are expensive and therefore difficult to apply to low-cost products.

Furthermore, given the intrinsic complexity thereof, such systems may feature malfunctions and generate a non-negligible amount of waste during the production thereof.

CN112110030A and US2003231923A1 describe further known prior art.

SUMMARY OF THE INVENTION

The object of the present invention is to provide a fluid substance dispensing device which is improved compared with those according to the prior art.

A further object of the invention is to provide a dispensing device which is simpler and less expensive than those according to the prior art.

A still further object of the present invention is to provide a dispensing device which is less complex, and therefore more reliable, than commonly known devices.

This and other objects are achieved by means of a fluid substance dispensing device produced according to the technical teachings of the appended claims.

BRIEF DESCRIPTION OF THE FIGURES

Further features and advantages of the innovation will become clearer in the description of a preferred but not exclusive embodiment of the device, illustrated—by way of a non-limiting example—in the drawings annexed hereto, in which.

DETAILED DESCRIPTION OF THE INVENTION

Figure 1:
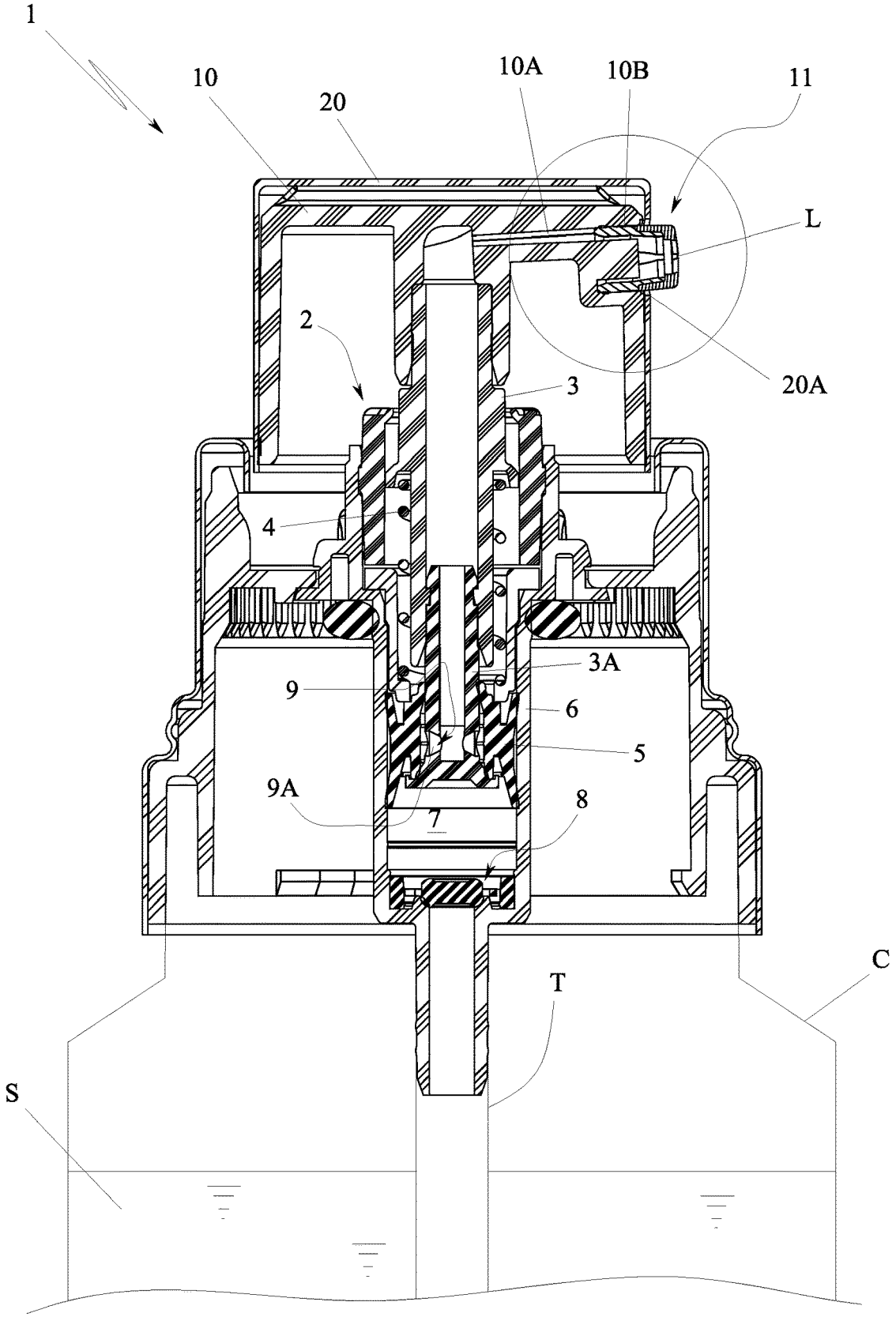
FIG. 1 is a simplified cross-sectional view of a device according to the invention.

With reference to the figures stated, reference number 1 is used to denote, as a whole, a fluid substance dispensing device.

The device 1 for dispensing a fluid substance S comprises a manually operated pump 2.

In the present wording, the term 'fluid substance S' means an essentially dense fluid substance, such as a cream, a soap, or a cosmetic fluid for make-up or a medical fluid.

The pump 2 is equipped with a hollow stem 3 for operation and moves against a spring 4.

The hollow stem 3 is coupled, for the movement thereof, with a piston 5 which slides in a sealed manner inside a cup-shaped body 6 so as to define a compression chamber 7 coupled with a first valve element 8 for the inlet of the fluid substance S into the compression chamber 7.

The first valve element 8 may be arranged on a bottom of the compression chamber 7 and intercepts a passageway which may be coupled with a dip tube T (if necessary). If the pump is coupled with an airless type deformable bag, the dip tube may not be present.

The pump may be coupled with a container C in which the fluid substance S can be housed (freely or inside a deformable airless bag).

The compression chamber 7 is fluidly coupled with a second valve element 9 for the outlet of the fluid substance from the compression chamber 7. In the example illustrated, the second valve element 9 comprises the piston 5, which slides along the stem to open or close a passageway for fluid 9A flowing into the cavity of the stem 5.

It should be noted that, for the sake of construction and assembly simplicity, in this case the stem 3 is formed of two parts which are mutually snap-fit coupled.

Mounted on the hollow stem 3A, at one of the free ends thereof, there is a dispensing button 10 equipped with a dispensing nozzle 11.

The dispensing button envisages at least one channel 10A for feeding the fluid substance to the nozzle 11, which essentially puts the cavity of the stem in communication with the said nozzle.

According to the invention, the nozzle 11 is formed of an essentially rigid body 12 which snap-couples in a sealed manner with a seat 10B in the dispenser button 10.

The rigid body 12 is coupled, so as to form the nozzle 11, with a deformable body 13 which defines a dispensing port L for the fluid substance S.

During dispensing, and therefore when the fluid substance flows into the dispensing port L, the deformable body 13—at least in proximity of the dispensing port L—deforms (see the dashed lines in FIG. 2), so as to allow constant dispensing of the fluid substance S through the port L.

Once dispensing is complete, the deformable body 13 returns to its non-deformed configuration, essentially closing up the dispensing port.

The deformable body 13, alone, defines the dispensing port.

Figure 3:
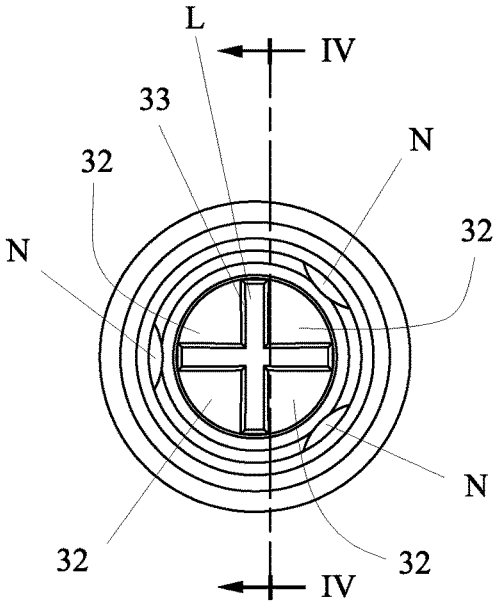
FIG. 3 is a disassembled rear view of a nozzle of the device in FIG. 1.

As can be seen from FIG. 3, the deformable body can define a cross-shaped dispensing port L; the port may also be configured as a line segment or as a 'cut', etc. The cross preferably has four arms, but configurations with three, five, six, eight arms etc. may also be envisaged.

When the deformable body 13 is in a deformation-free configuration, the dispensing port L can allow a slight passageway for air between the channel 10A and the outside. In this way, at a first delivery, it is possible to 'bleed' the compression chamber 7 of the pump to remove the air present there (before the said chamber is filled with the substance S to be dispensed).

In this wording, the term 'slight passageway for air' means that the port L envisages a slight possibility of air leakage. Essentially, the port L can be configured so as to allow the air from the dispensing channel to flow, but in such a way as to prevent the fluid substance S, which is denser than the air, dripping or running.

The presence of this slight air leakage through the dispensing port—which is intended, you are reminded, to facilitate and allow priming—minimises the possibility of the fluid substance S drying up at the dispensing port. Indeed, the part of the fluid substance S which comes into contact with the air has a very small volume, and, even if this part becomes dry due to contact with the air, it would not adversely affect subsequent dispensing, precisely because of the small or negligible volume thereof.

Preferably, according to the invention, the deformable body 13 is coupled with the rigid body 12 by overmoulding, and therefore forms what is essentially a single piece therewith.

This technology makes it possible to mould a section of the component in a first step (for example the rigid body 12) and in a second step, to inject—by means of a movement inside the mould—a second section (13) onto the first, within in a single moulding process. This technology makes it possible to create components consisting of a single piece but made of materials with different mechanical/physical characteristics. The adhesion of the two parts is achieved by means of chemical adhesion between the two materials. Mechanical anchorage systems may also be envisaged, which are essentially either protuberances or grooves 40 made on or in the surface of the rigid body 12, and therefore located at the interface between the rigid body and the deformable body. The presence of the protuberances or grooves 40, which may have any conformation, increases the contact surface between the two over-moulded parts and creates undercuts intended to improve and stabilise the adhesion over time.

Advantageously, the rigid body 12 may be made of one or more of the following plastic materials: HDPE-PP-PA-SANTOPRENE-HYTREL-PBT.

The deformable body, which—remember—can be overmoulded onto the rigid body, may advantageously be made of one or more of the following materials: LDPE-PA-SANTOPRENE -HYTREL-RUBBER.

The dispenser button 10, meanwhile, is advantageously made of: PP-PETG-ABS-PA.

For aesthetic purposes, the dispensing button 10 may be encased with a cover 20, for example made of metal or plastic with a glossy finish, etc. The cover may be endowed with an opening 20A at the said nozzle 11.

Figure 2:
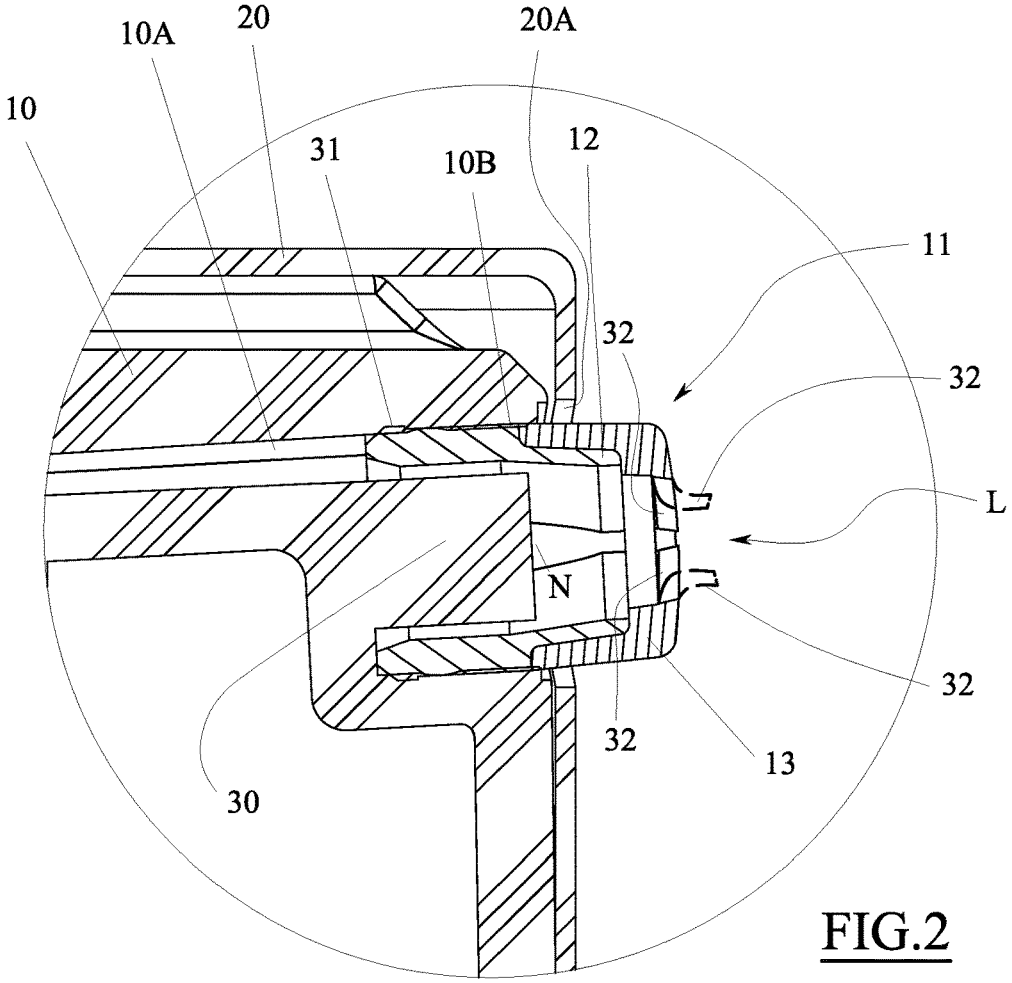
FIG. 2 is an enlargement of the part circled in FIG. 1.

For effective coupling with the nozzle, the dispensing button 10 may feature, at the seat 10B, a cylindrical element 30 onto which the nozzle 11 is fitted (see FIG. 2 for more information).

The cylindrical element is far or distant from the deformable body 13, allowing its free movement.

The nozzle 11 may feature centring ribs N on the cylindrical element 30.

A coupling of this kind minimises the risk of ovalisation of both the cylindrical element 30 and the rigid body 12 of the nozzle 11, making it possible in any case to machine-assemble the invention.

Figure 4:
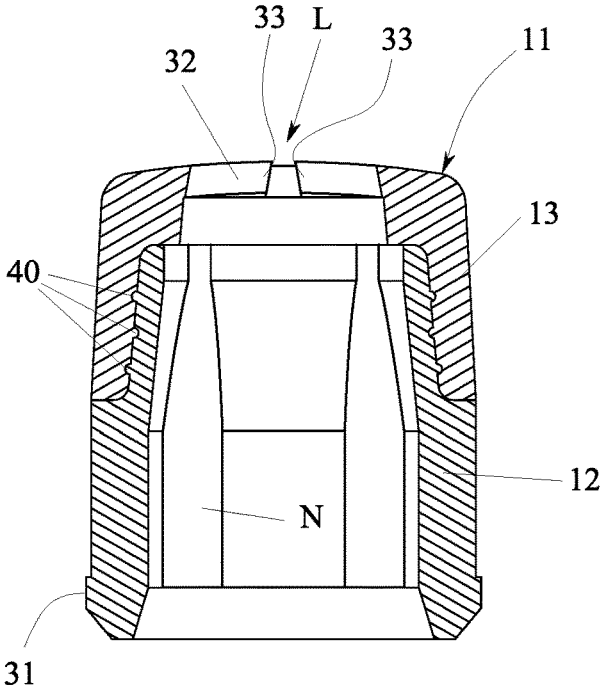
FIG. 4 is a section view taken along line IV-IV in FIG. 3.

As clearly visible in FIG. 4, the nozzle 11, or rather the rigid body 12, may feature, on the outside, a protruding annular edge 31, which is coupled with the seat 10B in a sealed manner by interference fit. This allows the nozzle to be snap fitted into its seat.

From the analysis of FIG. 3, it can be noted that at the dispensing port L, the deformable body 13 may feature at least two but preferably four flexible blades 32, which define the dispensing port L.

These are shown in FIG. 2 with a dashed line, when they are in a deformed configuration or during the passage of substance S through the port.

There may also be three flexible blades. In this case, the conformation of the dispensing port will feature three line segments branching off from the centre. Obviously, there may also be more than four flexible blades present.

In at least one area in which they are mutually facing, the said flexible blades 32, may feature an inclined surface converging towards the outside of the nozzle 11. This configuration benefits the deformation of the flexible blades when the substance S is dispensed and improves the 'cutting off' of a run of the substance S from the dispensing port.

Basically, the flexible blades 32 of the deformable body 12, in that part where the at least two flexible blades are mutually faced (directly), define the dispensing port L.

It has been seen that the described invention is simple to make and optimises the dispensing of creamy substances or substances with a certain density, minimising the possibility of runs and essentially 'protecting' a large part of the substance S left behind the nozzle 11 from the air and therefore minimising or eliminating the volume of this substance S which would otherwise dry up.

Various embodiments of the innovation have been disclosed herein, but further embodiments may also be conceived using the same innovative concept.

The invention claimed is:

1. Dispensing device (1) of a fluid substance (S) comprising a manually operated pump (2) equipped with a hollow stem (3) movable in contrast to an elastic element (4), the hollow stem (3) being associated to a piston (5) sealedly sliding inside a cup body (6) to define a compression chamber (7), the compression chamber (7) being associated with a first valve element (8) for the entry of the fluid substance (S) into the compression chamber (7), the compression chamber (7) being fluidly associated with a second valve element (9) for the outlet of the fluid substance from the compression chamber (7), on the hollow stem (3) being mounted a dispensing button (10) equipped of a dispensing nozzle (11), the dispensing button providing at least one channel (10A) for feeding the fluid substance to the nozzle (11), characterized in that the nozzle (11) is formed by a substantially rigid body (12) which is sealedly fixed in a seat (10B) of the dispenser button (10), the rigid body (12) being associated with a deformable body (13) which alone defines a dispensing port (L) of the fluid substance (S) so that, during dispensing, the deformable body (13) at least in proximity of the dispensing port (L) deforms, to return to its non-deformed configuration when dispensing is finished, the deformable body (13) being overmoulded on the rigid body (12), the dispensing button (10), in correspondence with the seat (10B) has a cylindrical element (30) on which the nozzle (11) is fitted, the cylindrical element (30) being distant from the deformable body (13), and the nozzle (11) has ribs (N), formed on the rigid body (12), centering the nozzle (11) on the cylindrical element (30).

2. Device according to claim 1, in which the rigid body has grooves and/or protrusions (40) configured to improve the adhesion between the deformable body and the rigid body by forming undercuts.

3. Device according to claim 1, wherein the deformable body defines a dispensing port (L) configured in a cross or linear segment.

4. Device according to claim 3, wherein the dispensing port (L), when the deformable body (13) is in a deformation-free configuration, allows a minimum passage of air between the channel (10A) and the outside.

5. Device according to claim 3, wherein the nozzle has, on the outside, a protruding annular edge (31) which is coupled tightly and by interference with the seat (10B).

6. Device according to claim 1, wherein the deformable body (13) in correspondence with the dispensing port (L), has at least two flexible blades (32) which define the dispensing port (L).

7. Device according to claim 6, in which said blades (32), in correspondence of at least one area in which they face each other, present an inclined surface (33) converging towards the outside of the nozzle (11).

8. Device according to claim 1, wherein the dispensing button (10) is covered with a cover (20) for aesthetic purposes, the cover being provided with an opening (20A) in correspondence with said nozzle (11).

9. Device according to claim 1, wherein the dispensing port (L) is defined by at least two flexible blades (32) of the deformable body (13) directly facing each other.

* * * * *